US007667569B2

(12) United States Patent
Iseki et al.

(10) Patent No.: US 7,667,569 B2
(45) Date of Patent: Feb. 23, 2010

(54) CHIP RESISTOR, AND ITS MANUFACTURING METHOD

(75) Inventors: Takeshi Iseki, Fukui (JP); Shuji Ariga, Fukui (JP); Mitsuaki Nakao, Fukui (JP)

(73) Assignee: Panasonic Corporation, Osaka (JP)

( * ) Notice: Subject to any disclaimer, the term of this patent is extended or adjusted under 35 U.S.C. 154(b) by 435 days.

(21) Appl. No.: 11/658,511

(22) PCT Filed: Jul. 22, 2005

(86) PCT No.: PCT/JP2005/013488

§ 371 (c)(1),
(2), (4) Date: Jan. 25, 2007

(87) PCT Pub. No.: WO2006/011425

PCT Pub. Date: Feb. 2, 2006

(65) Prior Publication Data

US 2008/0290460 A1 Nov. 27, 2008

(30) Foreign Application Priority Data

Jul. 27, 2004 (JP) ..... 2004-218167

(51) Int. Cl.
*H01C 1/012* (2006.01)

(52) U.S. Cl. ..... 338/309; 338/307; 29/610.1

(58) Field of Classification Search ..... 338/195, 338/307, 309, 313; 29/610.1, 620
See application file for complete search history.

(56) References Cited

U.S. PATENT DOCUMENTS

| | | | | |
|---|---|---|---|---|
| 5,379,017 | A * | 1/1995 | Katsuno | 338/332 |
| 5,548,269 | A * | 8/1996 | Katsuno et al. | 338/325 |
| 5,815,065 | A * | 9/1998 | Hanamura | 338/309 |
| 5,907,274 | A * | 5/1999 | Kimura et al. | 338/309 |
| 6,703,683 | B2 * | 3/2004 | Tanimura | 257/536 |

FOREIGN PATENT DOCUMENTS

| | | |
|---|---|---|
| JP | 9-205004 | 8/1997 |
| JP | 2000-216001 | 8/2000 |
| JP | 2002-203702 | 7/2002 |
| JP | 2002-367818 | 12/2002 |

* cited by examiner

*Primary Examiner*—Kyung Lee
(74) *Attorney, Agent, or Firm*—Wenderoth, Lind & Ponack, L.L.P.

(57) ABSTRACT

A chip resistor includes: a pair of upper surface electrodes formed at opposing side portions of a rectangular substrate as opposed to each other with respect to a center line of the rectangular substrate extending in a direction connecting the side portions; a resistive element formed on the rectangular substrate to be electrically connected with the upper surface electrode pair; and a pair of end surface electrodes formed on end surfaces of the opposing side portions of the rectangular substrate and electrically connected with the upper surface electrode pair. The chip resistor further includes dummy electrodes formed individually at the opposing side portions of the rectangular substrate at positions corresponding to the upper surface electrode pair in the direction connecting the side portions.

9 Claims, 9 Drawing Sheets

CHIP RESISTOR, AND ITS MANUFACTURING METHOD

TECHNICAL FIELD

The present invention relates to a chip resistor for use in various electronic devices, and a manufacturing method thereof.

BACKGROUND ART

Conventionally, there has been proposed a chip resistor, as shown in FIG. 16, to improve load characteristics such as anti-pulse characteristics by increasing the area and the length of a resistive element. The chip resistor shown in FIG. 16 includes a pair of upper surface electrodes 2 formed at positions on opposing sides of a rectangular substrate 1 made of e.g. alumina as opposed to each other with respect to a center line of the rectangular substrate 1 in a direction connecting the opposing sides, and a meander-shaped resistive element 3 to be electrically connected to the upper surface electrode pair 2.

In the aforementioned conventional chip resistor, the width of the upper surface electrode pair 2 is made substantially equal to or smaller than the half of the length of the opposing sides. With this arrangement, the resistive element 3 can be formed on an area where the upper surface electrodes 2 are not formed. As a result, the area and the length of the resistive element 3 can be increased to thereby improve load characteristics such as anti-pulse characteristics.

There are known Japanese Unexamined Patent Publication No. 9-205004 (D1) and Japanese Unexamined Patent Publication No. 2002-203702 (D2), as the prior art document information relating to the invention of the application.

In the aforementioned chip resistor, as shown in FIG. 17, upper surface electrodes 2 and resistive elements 3 are formed by printing, sputtering, or a like process, with use of a sheet-like substrate 1*a* on which a number of rectangular substrates 1 are to be formed in a checkered pattern via first dividing grooves 4*a* and second dividing grooves 4*b*. In such a general chip resistor manufacturing method, as shown in FIG. 17, if the upper surface electrodes 2 and the resistive elements 3 are formed with displacement by printing, sputtering, or a like process, the upper surface electrodes 2 may be formed away from the first dividing grooves 4*a*, i.e. away from the opposing sides of the respective rectangular substrates 1. If a number of substrate strips 1*b* are obtained by dividing the sheet-like substrate 1*a* in the displaced condition along the first dividing grooves 4*a*, and, as shown in FIG. 18, end surface electrodes 5 are formed on opposing end surfaces of each of the displaced rectangular substrates 1, electrical connection of the upper surface electrode 2 to the counterpart end surface electrode 5 may be impossible.

DISCLOSURE OF THE INVENTION

In order to solve the above-mentioned conventional disadvantages, it is an object of the invention to provide a chip resistor and a manufacturing method thereof that enable to securely perform electrical connection of an upper surface electrode to a counterpart end surface electrode even if a number of upper surface electrodes and resistive elements are formed with displacement by printing, sputtering, or a like process.

To accomplish the above object, a chip resistor according to an aspect of the invention comprises: a pair of upper surface electrodes formed at opposing side portions of a rectangular substrate as opposed to each other with respect to a center line of the rectangular substrate extending in a direction connecting the side portions; a resistive element formed on the rectangular substrate to be electrically connected to the upper surface electrode pair; a pair of end surface electrodes formed on end surfaces of the opposing side portions of the rectangular substrate, and electrically connected to the upper surface electrode pair; and dummy electrodes formed individually at the opposing side portions of the rectangular substrate at positions corresponding to the upper surface electrode pair in the direction connecting the side portions.

With the above arrangement, the dummy electrode pair is formed at the opposing side portions of the rectangular substrate at the positions symmetrical relative to the upper surface electrode pair with respect to the center line of the rectangular substrate extending in the direction orthogonal to the direction connecting the side portions. Accordingly, before a sheet-like substrate is divided into a number of the rectangular substrates, the upper surface electrodes formed at the opposing side portions of the respective rectangular substrates, and the dummy electrodes formed at the opposing side portions of the respective adjacent rectangular substrates are sequentially formed via first dividing grooves. With this arrangement, in forming the upper surface electrode pairs, the dummy electrode pairs, or the resistive elements by printing, sputtering, or a like process, with use of the sheet-like substrate where the number of the rectangular substrates are to be formed in a checkered pattern via the first dividing grooves and second dividing grooves, the following advantage is obtained. Specifically, even if forming position of the upper surface electrodes is displaced, and therefore, the upper surface electrodes are formed away from the first dividing grooves, i.e. away from the opposing end portions of the rectangular substrate, the dummy electrodes which are sequentially formed with the upper surface electrodes are formed over the first dividing grooves. This arrangement enables to securely perform electrical connection of the upper surface electrodes and the end surface electrodes via the counterpart dummy electrodes, in forming the end surface electrodes on the opposing end surfaces of each of substrate strips obtained by dividing the sheet-like substrate along the first dividing grooves. Also, the end surface electrodes are formed on the dummy electrodes as well as on the upper surface electrodes. This enables to improve adhesion of the end surface electrodes, as compared with an arrangement that the end surface electrodes are formed merely on the upper surface electrodes, because the adhesion force of the end surface electrodes to the electrodes is larger than the adhesion force of the end surface electrodes to the substrate.

A chip resistor according to another aspect of the invention comprises: a pair of upper surface electrodes formed at opposing side portions of a rectangular substrate in a direction along an extending direction of the side portions; and a resistive element formed on the rectangular substrate to be electrically connected to a part of the upper surface electrode pair and to be brought into close contact with a part of the upper surface electrode pair other than the electrically connectable parts, wherein a glass coat for covering the resistive element, with such dimensions as to bridge over the upper surface electrode pair, and a resin coat for covering the glass coat are formed on the rectangular substrate.

With the above arrangement, since the glass coat covers the space between the upper surface electrodes and the resistive element, even if the upper surface electrodes are made of a silver-based material, this arrangement enables to suppress electrical migration between the upper surface electrodes and the resistive element. Also, since the glass coat is covered with the resin coat, the resin coat prevents the glass coat from cracks at the time of production or use of the chip resistor. This is more advantageous in suppressing electrical migration.

A chip resistor manufacturing method according to yet another aspect of the invention comprises: a step of forming a pair of upper surface electrodes at inner positions of opposing first dividing grooves in each of rectangular substrates to be formed on a sheet-like substrate as opposed to each other with respect to a center line of the rectangular substrate extending in a direction connecting the opposing first dividing grooves, with use of the sheet-like substrate where a number of the rectangular substrates are to be formed in a checkered pattern via the first dividing grooves and second dividing grooves; a step of forming a pair of dummy electrodes at inner positions of the opposing first dividing grooves in the each of the rectangular substrates to be formed on the sheet-like substrate at positions symmetrical relative to the upper surface electrode pair with respect to a center line of the rectangular substrate extending in a direction orthogonal to the direction connecting the opposing first dividing grooves; a step of forming a resistive element on the each of the rectangular substrates to be electrically connected to the upper surface electrode pair; and a step of forming end surface electrodes on opposing end surfaces of a substrate strip obtained by dividing the sheet-like substrate along the first dividing grooves so that the end surface electrodes are electrically connected to the upper surface electrode pair, wherein the upper surface electrode formation step and the dummy electrode formation step are simultaneously conducted so that the one of the dummy electrodes and the one of the upper surface electrodes on the respective rectangular substrates are respectively electrically connected to the corresponding one of the upper surface electrodes and to the corresponding one of the dummy electrodes on the respective adjacent rectangular substrates via the first dividing grooves.

The above-mentioned manufacturing method comprises the step of forming the dummy electrode pair at the inner positions of the opposing first dividing grooves in each of the rectangular substrates to be formed on the sheet-like substrate at the positions symmetrical relative to the upper surface electrode pair with respect to the center line of the rectangular substrate extending in the direction orthogonal to the direction connecting the opposing first dividing grooves, and has the feature that the upper surface electrodes and the dummy electrodes are simultaneously formed so that the one of the dummy electrodes and the one of the upper surface electrodes on the respective rectangular substrates are respectively electrically connected to the corresponding one of the upper surface electrodes and to the corresponding one of the dummy electrodes on the respective adjacent rectangular substrates via the first dividing grooves. With this arrangement, before the sheet-like substrate is divided to obtain the number of the rectangular substrates, the upper surface electrodes formed at the inner positions of the opposing first dividing grooves in the respective rectangular substrates to be formed on the sheet-like substrate, and the dummy electrodes formed at the inner positions of the opposing first dividing grooves in the respective rectangular substrates adjacent the one rectangular substrate are sequentially formed via the first dividing grooves. With this arrangement, in forming the upper surface electrode pairs, the dummy electrode pairs, or the resistive elements by printing, sputtering, or a like process, with use of the sheet-like substrate where the number of the rectangular substrates are to be formed in a checkered pattern via the first dividing grooves and second dividing grooves, the following advantage is obtained. Specifically, even if forming position of the upper surface electrodes is displaced, and therefore, the upper surface electrodes are formed away from the first dividing grooves, the dummy electrodes which are sequentially formed with the upper surface electrodes are formed over the first dividing grooves. This arrangement enables to securely perform electrical connection of the upper surface electrodes and the end surface electrodes via the counterpart dummy electrodes, in forming the end surface electrodes on the opposing end surfaces of each of the substrate strips obtained by dividing the sheet-like substrate along the first dividing grooves. Also, the end surface electrodes are formed on the dummy electrodes as well as on the upper surface electrodes. This enables to improve adhesion of the end surface electrodes, as compared with an arrangement that the end surface electrodes are formed merely on the upper surface electrodes, because the adhesion force of the end surface electrodes to the electrodes is larger than the adhesion force of the end surface electrodes to the substrate.

A chip resistor manufacturing method according to still another aspect of the invention comprises: a step of forming a pair of upper surface electrodes at inner positions of opposing first dividing grooves in each of rectangular substrates to be formed on a sheet-like substrate in a direction along an extending direction of the first dividing grooves, by forming the respective electrodes on an area substantially covering the first dividing grooves in the sheet-like substrate, with use of the sheet-like substrate where a number of the rectangular substrates are to be formed in a checkered pattern via the first dividing grooves and second dividing grooves; a step of forming a resistive element on each of the rectangular substrates to be electrically connected to a part of the upper surface electrode pair and to be brought into close contact with a part of the upper surface electrode pair other than the electrically connectable parts; a step of forming, on the each of the rectangular substrates to be formed on the sheet-like substrate, a glass coat for covering the resistive element, with such dimensions as to bridge over the upper surface electrode pair, and of forming a resin coat for covering the glass coat; and a step of forming end surface electrodes on opposing end surfaces of a substrate strip obtained by dividing the sheet-like substrate along the first dividing grooves so that the end surface electrodes are electrically connected to the upper surface electrode pair.

According to the above manufacturing method, since the glass coat covers the space between the upper surface electrodes and the resistive element, even if the upper surface electrodes are made of a silver-based material, this arrangement enables to suppress electrical migration between the upper surface electrodes and the resistive element. Also, since the glass coat is covered with the resin coat, the resin coat prevents the glass coat from cracks at the time of production or use of the chip resistor. This is more advantageous in suppressing electrical migration.

BEST MODE FOR CARRYING OUT THE INVENTION

First Embodiment

In the following, the first embodiment of the invention is described.

Figure 1:
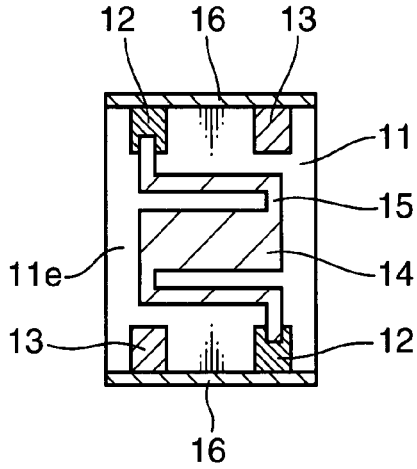
FIG. 1 is a top plan view of a chip resistor as a first embodiment of the invention.

FIG. 1 is a top plan view of a chip resistor as a first embodiment of the invention.

Referring to FIG. 1, the reference numeral 11 denotes a rectangular substrate made of alumina, with an oblong shape in planar view. The reference numeral 12 denotes a pair of upper surface electrodes formed at opposing side portions on an upper surface of the rectangular substrate 11 as opposed to each other with respect to a center line extending in a direction connecting the opposing side portions of the rectangular substrate 11 i.e. the longer-side direction of the rectangular substrate 11. The upper surface electrode pair 12 is formed by screen-printing an electrode paste containing silver as a main ingredient and by sintering the electrode paste at 850° C. The reference numeral 13 denotes a pair of dummy electrodes formed at the opposing side portions on the upper surface of the rectangular substrate 11 at positions symmetrical relative to the upper surface electrode pair 12 with respect to a center line extending in a direction orthogonal to the direction connecting the opposing side portions of the rectangular substrate 11, i.e. the shorter-side direction of the rectangular substrate 11. The dummy electrode pair 13 has substantially the same width and the same length as those of the upper surface electrode pair 12. The dummy electrode pair 13 is formed by screen-printing an electrode paste containing silver as a main ingredient and by sintering the electrode paste at 850° C. simultaneously with the formation of the upper surface electrode pair 12. The reference numeral 14 denotes a resistive element which is bridgingly formed between the upper surface electrode pair 12 on the upper surface of the rectangular substrate 11 to be electrically connected to the upper surface electrode pair 12. The resistive element 14 is formed by screen-printing a resistive paste of ruthenium-based oxide and by sintering the resistive paste at 850° C. The resistive element 14 has a meandering portion 15, and is meanderingly formed between the upper surface electrode pair 12. The reference numeral 16 denotes a pair of end surface electrodes formed on end surfaces of the opposing side portions on the upper surface of the rectangular substrate 11 to be electrically connected with the upper surface electrode pair 12 and with the dummy electrode pair 13. The end surface electrode pair 16 is formed by coating an end surface electrode material containing silver and an epoxy resin and by curing the electrode material at 200° C.

Figure 2:
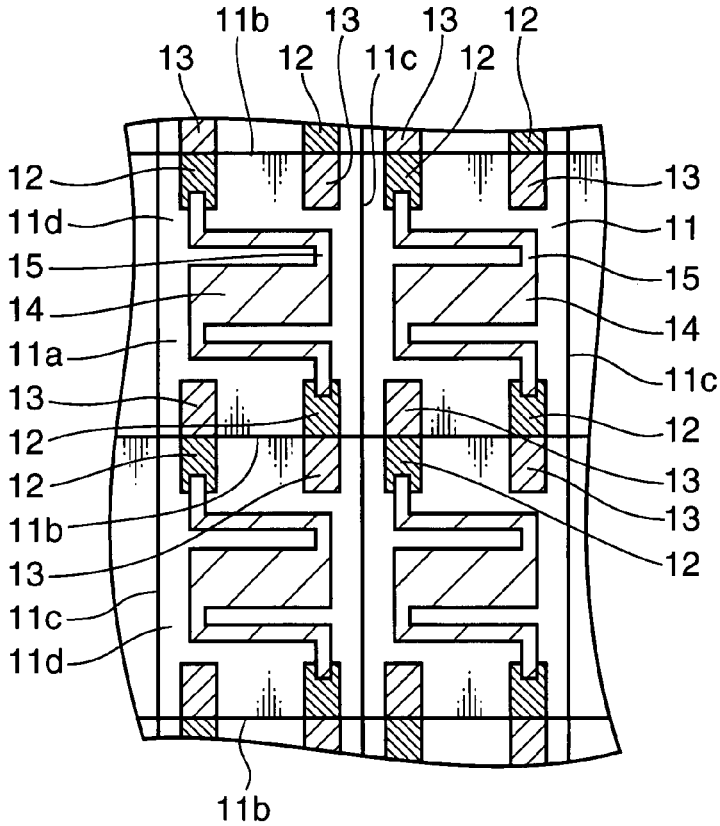
FIG. 2 is a top plan view of a sheet-like substrate to be used in a process for manufacturing the chip resistor.

FIG. 2 is a top plan view of a sheet-like substrate to be used in a process for manufacturing the chip resistor according to the first embodiment of the invention.

The sheet-like substrate 11*a* shown in FIG. 2 is formed with, on one surface or both surfaces thereof, first dividing grooves 11*b* for dividing the sheet-like substrate 11*a* into a number of substrate strips, and second dividing grooves 11*c* for dividing the substrate strips into a number of substrate pieces, in a grid pattern. With this arrangement, the sheet-like substrate 11*a* has a number of rectangular substrates 11 to be formed in a checkered pattern via the first dividing grooves 11*b* and the second dividing grooves 11*c*.

In the following, a method for manufacturing the chip resistor according to the first embodiment of the invention is described referring to FIG. 2.

First, an upper surface electrode pair 12 and a dummy electrode pair 13 are simultaneously formed by screen-printing an electrode paste containing silver as a main ingredient and by sintering the electrode paste at 850° C. at inner positions of the opposing first dividing grooves 11*b* in each of rectangular substrates 11 to be formed on the sheet-like substrate 11*a* in FIG. 2 at positions symmetrical to each other with respect to a center line extending in a direction orthogonal to a direction connecting the opposing first dividing grooves 11*b* in the rectangular substrate 11. The direction connecting the opposing first dividing grooves 11*b* in the rectangular substrate 11 corresponds to the longer-side direction of the rectangular substrate 11. In other words, the center line extends in the shorter-side direction of the rectangular substrate 11. In the formation, each of the upper surface electrode pairs 12 is formed as opposed to each other with respect to a center line extending in the direction connecting the opposing first dividing grooves 11*b* in the rectangular substrate 11 i.e. the longer-side direction of the rectangular substrate 11; and likewise, each of the dummy electrode pairs 13 is formed as opposed to each other with respect to the center line extending in the direction connecting the opposing dividing grooves 11*b* in the rectangular substrate 11 i.e. the longer-side direction of the rectangular substrate 11. With this arrangement, on the sheet-like substrate 11*a*, as shown in FIG. 2, the upper surface electrodes 12 formed at the inner positions of the opposing first dividing grooves 11*b* in the respective rectangular substrates 11 to be formed on the sheet-like substrate 11*a*, and the counterpart dummy electrodes 13 formed at the inner positions of the opposing first dividing grooves 11*b* in the respective adjacent rectangular substrates 11 are sequentially formed and are electrically connected to each other by way of the first dividing grooves 11*b*.

Next, resistive elements 14 each in a predetermined shape and with a meandering portion 15 are formed by screen-printing a resistive paste of ruthenium-based oxide on the upper surface of the respective rectangular substrates 11 and by sintering the resistive paste at 850° C. so that each of the resistive elements 14 is bridgingly formed between the upper surface electrode pair 12 and are electrically connected thereto.

The meandering portion 15 of the resistive element 14 may be formed by forming a trimming groove in the resistive element 14 by laser processing after forming the resistive element 14 on the rectangular substrate 11.

Next, a first protective film (not shown) made of a glass material is formed over the entirety of the respective resistive elements 14, and then, a trimming groove is formed in the respective resistive elements 14 by laser processing via the first protective film (not shown). Thus, a resistance of the respective resistive elements 14 is corrected. The resistance correction is carried out by forming the trimming groove in the resistive element 14 by laser processing while measuring a four-terminal resistance. In the first embodiment, the upper surface electrode pairs 12 and the dummy electrode pairs 13 are simultaneously formed, so that the upper surface electrodes 12 formed at the inner positions of the opposing first dividing grooves 11*b* in the respective rectangular substrates 11 to be formed on the sheet-like substrate 11*a*, and the counterpart dummy electrodes 13 formed at the inner positions of the opposing first dividing grooves 11*b* in the respective adjacent rectangular substrates 11 are sequentially formed and are electrically connected to each other by way of the first dividing grooves 11*b*. With this arrangement, in the state shown in FIG. 2, the resistance of the respective resistive elements 14 can be measured by contacting a terminal for measuring a four-terminal resistance against a targeted upper surface electrode pair 12 and a targeted dummy electrode pair 13. This enables to secure a large contact area for the terminal for measuring a four-terminal resistance, which is advantageous in securely performing the four-terminal resistance measurement.

Next, a second protective film (not shown) made of an epoxy resin is formed over the entirety of the first protective film (not shown) and on a part of the upper surface electrodes 12 by screen-printing.

Next, a number of substrate strips 11*d* are formed by dividing the sheet-like substrate 11*a* along the first dividing grooves 11*b*. Thereafter, end surface electrodes 16 are formed by coating an end surface electrode material containing silver and an epoxy resin onto end surfaces of each of the substrate strips 11*d* so that the end surface electrodes 16 are electrically connected with the counterpart upper surface electrodes 12 and with the counterpart dummy electrodes 13.

Next, a number of substrate pieces 11*e*, one of which is shown in FIG. 1, are formed by dividing the substrate strips 11*d* along the second dividing grooves 11*c*. Thereafter, by coating the end surface electrodes 16 of each of the substrate pieces 11*e* with nickel plating (not shown) and tin plating (not shown), the chip resistor as shown in FIG. 1 is produced.

Figure 3:
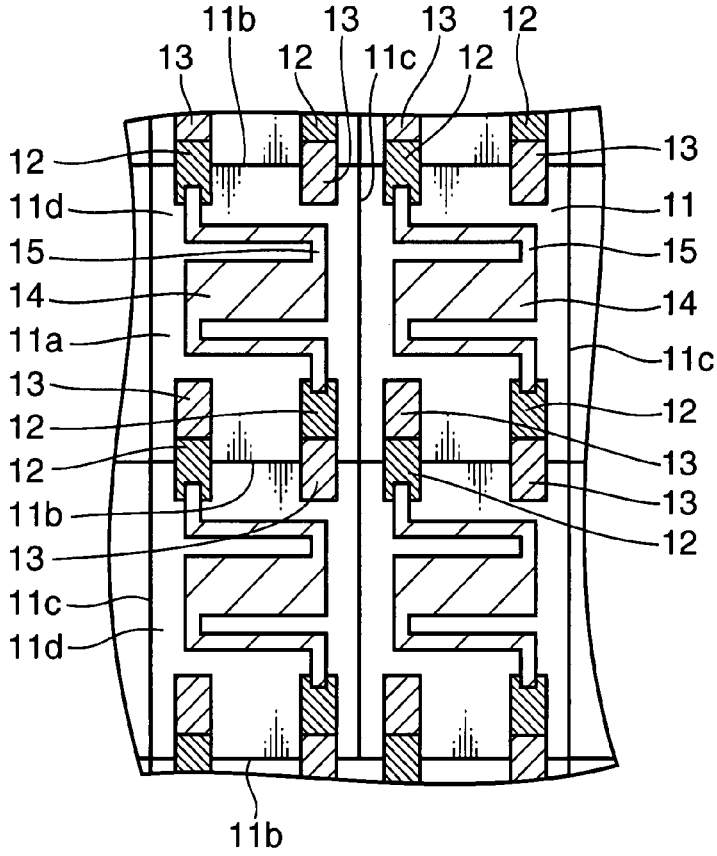
FIG. 3 is a top plan view of a sheet-like substrate with printing displacement of upper surface electrodes in the chip resistor manufacturing process.
Figure 4:
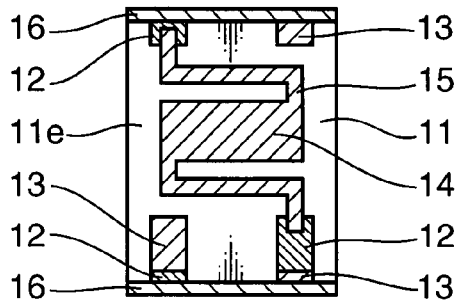
FIG. 4 is a top plan view of a substrate piece obtained by dividing the sheet-like substrate shown in FIG. 3.

In the first embodiment, as mentioned above, the upper surface electrode pair 12 and the dummy electrode pair 13 are formed symmetrical to each other at the inner positions of the opposing first dividing grooves 11*b* in each of the rectangular substrates 11 to be formed on the sheet-like substrate 11*a* with respect to the center line extending in the direction orthogonal to a direction connecting the opposing first dividing grooves 11*b* in the rectangular substrate 11. The direction connecting the opposing first dividing grooves 11*b* in the rectangular substrate 11 corresponds to the longer-side direction of the rectangular substrate 11. In other words, the center line extends in the shorter-side direction of the rectangular substrate 11. Further, the upper surface electrodes 12 and the dummy electrodes 13 are simultaneously formed in such a manner that the dummy electrodes 13 and the upper surface electrodes 12 on the rectangular substrates 11 adjacent to each other are connected to each other by way of the first dividing grooves 11*b*. With this arrangement, before the sheet-like substrate 11*a* is divided into a number of the rectangular substrates 11, the sheet-like substrate 11*a* is constructed in such a manner that the upper surface electrodes 12 formed at the inner positions of the opposing first dividing grooves 11*b* in the respective rectangular substrates 11 to be formed on the sheet-like substrate 11*a*, and the dummy electrodes 13 formed at the inner positions of the opposing first dividing grooves 11*b* in the respective adjacent rectangular substrates 11 are sequentially formed by way of the first dividing grooves 11*b*. With this arrangement, in forming the upper surface electrode pairs 12, the dummy electrode pairs 13, or the resistive elements 14 by screen-printing, with use of the sheet-like substrate 11*a* where the number of the rectangular substrates 11 are to be formed in a checkered pattern via the first dividing grooves 11*b* and the second dividing grooves 11*c*, the following advantage is obtained. Specifically, as shown in FIG. 3, for instance, even if printing position of the upper surface electrodes 12 is displaced, and therefore, the upper surface electrodes 12 are formed away from the first dividing grooves 11*b*, the dummy electrodes 13 which are sequentially formed with the upper surface electrodes 12 are formed over the first dividing grooves 11*b*. This arrangement enables to securely perform electrical connection of the upper surface electrode 12 and the end surface electrode 16 via the counterpart dummy electrode 13, as shown in FIG. 4, in forming the end surface electrodes 16 on the opposing end surfaces of each of the substrate strips 11*d*, after the sheet-like substrate 11*a* is divided into the number of the substrate strips 11*d* along the first dividing grooves 11*b*.

Also, the upper surface electrodes 12 and the dummy electrodes 13 are sequentially formed via the first dividing grooves 11*b*. This enables to secure a large contact area for the terminal for measuring a four-terminal resistance in measuring the resistance of the respective resistive elements 14. This is advantageous in securely performing the four-terminal resistance measurement.

Figure 5A:
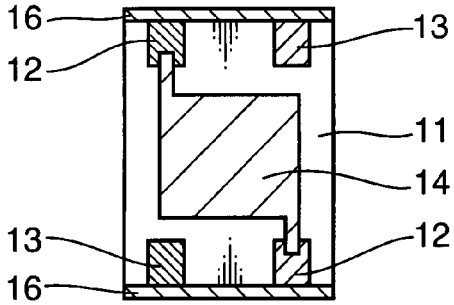
FIGS. 5A and 5B are top plan views showing modified patterns of a resistive element of the chip resistor.
Figure 5B:
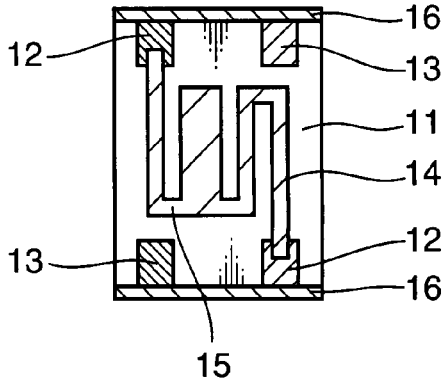

FIGS. 6A and 5B are diagrams showing modified patterns of the resistive element 14 in the chip resistor according to the first embodiment of the invention. As shown in FIG. 5A, the meandering portion 15 may be eliminated from the resistive element 14. Further alternatively, as shown in FIG. 5B, the meandering portion 15 may be formed into various shapes.

In the first embodiment, the upper surface electrodes 12 and the dummy electrodes 13 are formed by screen-printing the electrode paste containing silver as the main ingredient and by sintering the electrode paste at 850° C.; and the resistive elements 14 are formed by screen-printing the resistive paste of ruthenium-based oxide and by sintering the resistive paste at 850° C. The method for forming the upper surface electrodes 12, the dummy electrodes 13, and the resistive elements 14 is not limited to the above, but may be formed by using a metallic thin film obtained by sputtering or a like process. The altered arrangement also enables to obtain a similar effect as in the first embodiment.

Figure 6:
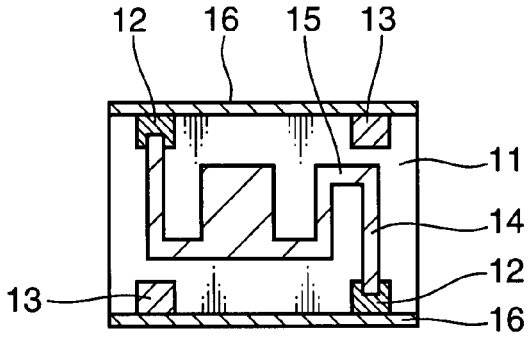
FIG. 6 is a top plan view showing a modification of the chip resistor in the first embodiment of the invention.

FIG. 6 is a top plan view showing a modification of the chip resistor according to the first embodiment of the invention. FIG. 6 is different from FIG. 1 describing the first embodiment in that a pair of upper surface electrodes 12 are formed at opposing side portions on an upper surface of a rectangular substrate 11 as opposed to each other with respect to a center line extending in a direction connecting the opposing side portions of the rectangular substrate 11 i.e. the shorter-side direction of the rectangular substrate 11. A pair of dummy electrodes 13 are formed at the opposing side portions on the upper surface of the rectangular substrate 11 at positions symmetrical relative to the upper surface electrode pair 12 with respect to a center line extending in a direction orthogonal to the direction connecting the opposing side portions of the rectangular substrate 11 i.e. the longer-side direction of the rectangular substrate 11. Also, a resistive element 14 is bridgingly formed between the upper surface electrode pair 12 to be electrically connected thereto. Further, a pair of end surface electrodes 16 are formed on end surfaces of the opposing side portions of the upper surface of the rectangular substrate 11 so that the end surface electrodes 16 are electrically connected with the upper surface electrode pair 12 and with the dummy electrode pair 13. With the modified arrangement, a similar effect as in the first embodiment can also be obtained.

Second Embodiment

In the following, the second embodiment of the invention is described.

Figure 7:
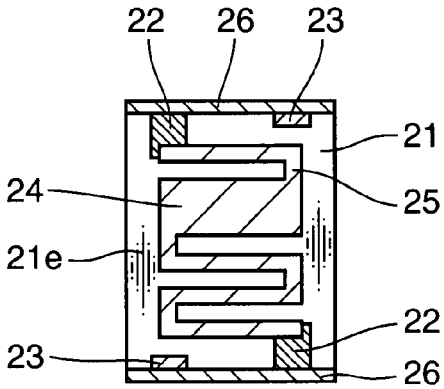
FIG. 7 is a top plan view of a chip resistor in a second embodiment of the invention.

FIG. 7 is a top plan view of a chip resistor according to the second embodiment of the invention.

Referring to FIG. 7, the reference numeral 21 denotes a rectangular substrate made of alumina, with an oblong shape in planar view. The reference numeral 22 denotes a pair of upper surface electrodes formed at opposing side portions on an upper surface of the rectangular substrate 21 as opposed to each other with respect to a center line extending in a direction connecting the opposing side portions of the rectangular substrate 21 i.e. the longer-side direction of the rectangular substrate 21. The upper surface electrode pair 22 is formed by screen-printing an electrode paste containing silver as a main ingredient and by sintering the electrode paste at 850° C. The reference numeral 23 denotes a pair of dummy electrodes formed at the opposing side portions on the upper surface of the rectangular substrate 21 at positions symmetrical relative to the upper surface electrode pair 22 with respect to a center line extending in a direction orthogonal to a direction connecting the opposing side portions of the rectangular substrate 21. The direction connecting the opposing side portions of the rectangular substrate 21 corresponds to the longer-side direction of the rectangular substrate 21. In other words, the center line extends in the shorter-side direction of the rectangular substrate 21. The dummy electrode 23 is smaller in shape than the upper surface electrode 22, with its width substantially the same as that of the upper surface electrode 22, and its length shorter than that of the upper surface electrode 22. The dummy electrode pair 23 is formed by screen-printing an electrode paste containing silver as a main ingredient and by sintering the electrode paste at 850° C. simultaneously with the formation of the upper surface electrode pair 22. With this arrangement, each of the upper surface electrode pair 22 protrudes inwardly from the counterpart dummy electrode 23 in the longer-side direction of the rectangular substrate 21. The reference numeral 24 denotes a resistive element which is bridgingly formed between the upper surface electrode pair 22 on the upper surface of the rectangular substrate 21 to be electrically connected to the upper surface electrode pair 22. The resistive element 24 is formed by screen-printing a resistive paste of ruthenium-based oxide and by sintering the resistive paste at 850° C. The resistive element 24 has a meandering portion 25, and is meanderingly formed between the upper surface electrode pair 22. The reference numeral 26 denotes a pair of end surface electrodes formed on end surfaces of the opposing side portions on the upper surface of the rectangular substrate 21 so that the end surface electrodes 26 are electrically connected with the upper surface electrode pair 22 and with the dummy electrode pair 23. The end surface electrode pair 26 is formed by coating an end surface electrode material containing silver and an epoxy resin and by curing the electrode material at 200° C. The end surface electrode pair 26 is formed at both end portions on the upper surface of the rectangular substrate 21 to such an extent as to cover substantially the corresponding dummy electrode 23 which is smaller in shape than the upper surface electrode 22. Preferably, the respective end surface electrodes 26 may cover substantially the entire surface e.g. 90 to 100% of the corresponding dummy electrode 23.

Figure 8:
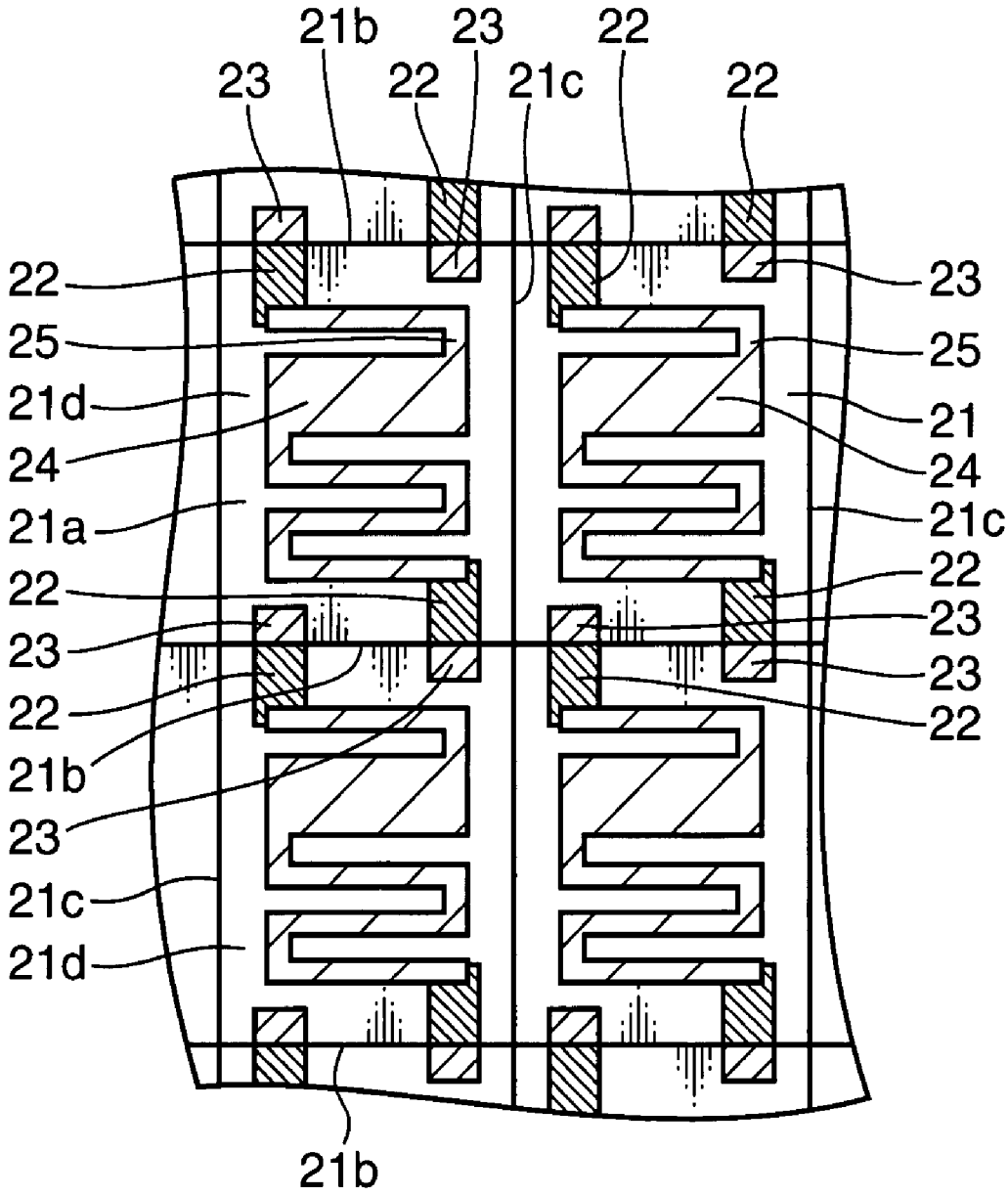
FIG. 8 is a top plan view of a sheet-like substrate to be used in a process for manufacturing the chip resistor in the second embodiment.

FIG. 8 is a top plan view of a sheet-like substrate to be used in a process for manufacturing the chip resistor according to the second embodiment of the invention.

The sheet-like substrate 21*a* shown in FIG. 8 is formed with, on one surface or both surfaces thereof, first dividing grooves 21*b* for dividing the sheet-like substrate 21*a* into a number of substrate strips, and second dividing grooves 21*c* for dividing the substrate strips into a number of substrate pieces, in a grid pattern. With this arrangement, the sheet-like substrate 21*a* has a number of rectangular substrates 21 to be formed in a checkered pattern via the first dividing grooves 21*b* and the second dividing grooves 21*c*.

In the following, a method for manufacturing the chip resistor according to the second embodiment of the invention is described referring to FIG. 8.

First, an upper surface electrode pair 22 and a dummy electrode pair 23 are simultaneously formed by screen-printing an electrode paste containing silver as a main ingredient and by sintering the electrode paste at 850° C. at inner positions of the opposing first dividing grooves 21*b* in each of rectangular substrates 21 to be formed on the sheet-like substrate 21*a* in FIG. 8 at positions symmetrical to each other with respect to a center line extending in a direction orthogonal to a direction connecting the opposing first dividing grooves 21*b* of the rectangular substrate 21. The direction connecting the opposing first dividing grooves 21*b* of the rectangular substrate 21 corresponds to the longer-side direction of the rectangular substrate 21. In other words, the center line extends in the shorter-side direction of the rectangular substrate 21. In the formation, each of the upper surface electrode pairs 22 is formed as opposed to each other with respect to a center line extending in the direction connecting the opposing first dividing grooves 21*b* of the rectangular substrate 21 i.e. the longer-side direction of the rectangular substrate 21; and likewise, each of the dummy electrode pairs 23 is formed as opposed to each other with respect to the center line extending in the direction connecting the opposing dividing grooves 21*b* of the rectangular substrate 21 i.e. the longer-side direction of the rectangular substrate 21. With this arrangement, on the sheet-like substrate 21*a*, as shown in FIG. 8, the upper surface electrodes 22 formed at the inner positions of the opposing first dividing grooves 21*b* in the respective rectangular substrates 21 to be formed on the sheet-like substrate 21*a*, and the counterpart dummy electrodes 23 formed at the inner positions of the opposing first dividing grooves 21*b* in the respective adjacent rectangular substrates 21 are sequentially formed and are electrically connected to each other by way of the first dividing grooves 21*b*.

Next, resistive elements 24 each in a predetermined shape and with a meandering portion 25 are formed by screen-printing a resistive paste of ruthenium-based oxide on the upper surface of the respective rectangular substrates 21 and by sintering the resistive paste at 850° C. so that each of the resistive elements 24 is bridgingly formed between the upper surface electrode pair 22 and are electrically connected thereto.

Next, a first protective film (not shown) made of a glass material is formed over the entirety of the respective resistive elements 24, and then, a trimming groove is formed in the respective resistive elements 24 by laser processing via the first protective film (not shown). Thus, a resistance of the respective resistive elements 24 is corrected. The resistance correction is carried out by forming the trimming groove in the resistive element 24 by laser processing while measuring a four-terminal resistance. In the second embodiment, the upper surface electrode pairs 22 and the dummy electrode pairs 23 are simultaneously formed, so that the upper surface electrodes 22 formed at the inner positions of the opposing first dividing grooves 21*b* in the respective rectangular substrates 21 to be formed on the sheet-like substrate 21*a*, and the counterpart dummy electrodes 23 formed at the inner positions of the opposing first dividing grooves 21*b* in the respective adjacent rectangular substrates 21 are sequentially formed and are electrically connected to each other by way of the first dividing grooves 21*b*. With this arrangement, in the state shown in FIG. 8, a large contact area can be secured for the terminal for measuring a four-terminal resistance, which is advantageous in securely performing the four-terminal resistance measurement.

Next, a second protective film (not shown) made of an epoxy resin is formed over the entirety of the first protective film (not shown) and on a part of the upper surface electrodes 22 by screen-printing.

Next, a number of substrate strips 21*d* are formed by dividing the sheet-like substrate 21*a* along the first dividing grooves 21*b*. Thereafter, end surface electrodes 26 are formed by coating an end surface electrode material containing silver and an epoxy resin onto end surfaces of each of the substrate strips 21*d* so that the end surface electrodes 26 are electrically connected with the counterpart upper surface electrodes 22 and with the counterpart dummy electrodes 23. In this arrangement, the end surface electrodes 26 are formed at both end portions on an upper surface of the substrate strip 21*d* to such an extent as to cover substantially the entire surface of the corresponding dummy electrode 23 which is smaller in shape than the upper surface electrode 22.

Next, a number of substrate pieces 21*e*, one of which is shown in FIG. 7, are formed by dividing the substrate strips 21*d* along the second dividing grooves 21*c*. Thereafter, by coating the end surface electrodes 26 of each of the substrate pieces 21*e* with nickel plating (not shown) and tin plating (not shown), the chip resistor as shown in FIG. 7 is produced.

Figure 9:
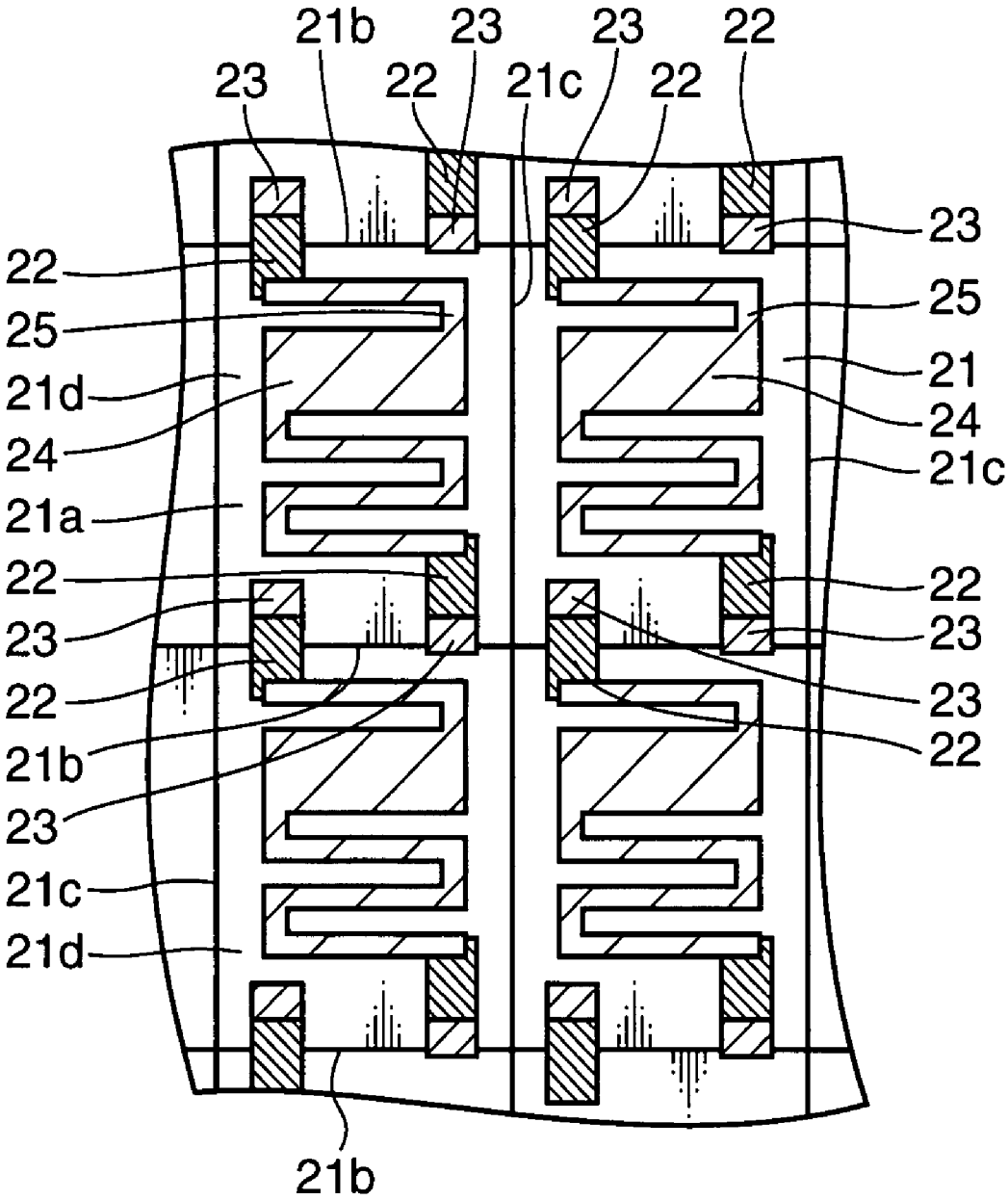
FIG. 9 is a top plan view of a sheet-like substrate with printing displacement of upper surface electrodes in the chip resistor manufacturing process in the second embodiment.
Figure 10:
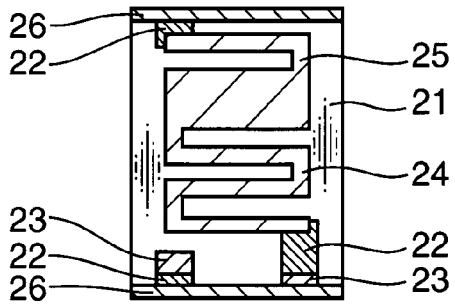
FIG. 10 is a top plan view of a substrate piece obtained by dividing the sheet-like substrate shown in FIG. 9.

In the second embodiment, as mentioned above, the upper surface electrode pair 22 and the dummy electrode pair 23 are formed symmetrical to each other at the inner positions of the opposing first dividing grooves 21*b* in each of the rectangular substrates 21 to be formed on the sheet-like substrate 21*a* with respect to the center line extending in the direction orthogonal to a direction connecting the opposing first dividing grooves 21*b* in the rectangular substrate 21. The direction connecting the opposing first dividing grooves 21*b* in the rectangular substrate 21 corresponds to the longer-side direction of the rectangular substrate 21. In other words, the center line extends in the shorter-side direction of the rectangular substrate 21. Further, the upper surface electrodes 22 and the dummy electrodes 23 are simultaneously formed in such a manner that the dummy electrodes 23 and the upper surface electrodes 22 on the rectangular substrates 21 adjacent to each other are connected to each other by way of the first dividing grooves 21*b*. With this arrangement, before the sheet-like substrate 21*a* is divided into a number of the rectangular substrates 21, the sheet-like substrate 21*a* is constructed in such a manner that the upper surface electrodes 22 formed at the inner positions of the opposing first dividing grooves 21*b* in the respective rectangular substrates 21, and the dummy electrodes 23 formed at the inner positions of the opposing first dividing grooves 21*b* in the respective adjacent rectangular substrates 21 are sequentially formed by way of the first dividing grooves 21*b*. With this arrangement, in forming the upper surface electrode pairs 22, the dummy electrode pairs 23, or the resistive elements 14 by screen-printing, with use of the sheet-like substrate 21*a* where the number of the rectangular substrates 21 are to be formed in a checkered pattern via the first dividing grooves 21*b* and the second dividing grooves 21*c*, the following advantage is obtained. Specifically, as shown in FIG. 9, for instance, even if printing position of the upper surface electrodes 22 is displaced, and therefore, the upper surface electrodes 22 are formed away from the first dividing grooves 21*b*, the dummy electrodes 23 which are sequentially formed with the upper surface electrodes 22 are formed over the first dividing grooves 21*b*. This arrangement enables to securely perform electrical connection of the upper surface electrode 22 and the end surface electrode 26 via the counterpart dummy electrode 23, as shown in FIG. 10, in forming the end surface electrodes 26 on the opposing end surfaces of the substrate strip 21*d*, after the sheet-like substrate 21*a* is divided into the number of substrate strips 21*d* along the first dividing grooves 21*b*.

Also, in the second embodiment, the upper surface electrodes 22 and the dummy electrodes 23 are sequentially formed via the first dividing grooves 21*b*. This enables to secure a large contact area for the terminal for measuring a four-terminal resistance in measuring the resistance of the respective resistive elements 24. This is advantageous in securely performing the four-terminal resistance measurement.

Further, in the second embodiment, the dummy electrode 23 is smaller in shape than the upper surface electrode 22. Specifically, the dummy electrode 23 has substantially the same width as that of the upper surface electrode 22, but has a length smaller than that of the upper surface electrode 22. With this arrangement, the area and the length of the resistive element 24 can be made larger by the size difference between the dummy electrode 23 and the upper surface electrode 22, which is advantageous in improving load characteristics such as anti-pulse characteristics.

Furthermore, in the second embodiment, the end surface electrode pair 26 is formed at the both end portions on the upper surface of the substrate strip 21*d* to such an extent as to cover substantially the entire surface of the corresponding dummy electrode 23 which is smaller in shape than the upper surface electrode 22. This arrangement enables to hide the dummy electrodes 23, which is advantageous in eliminating likelihood that an inspection instrument may erroneously identify the dummy electrodes 23 as the upper surface electrodes 22 at the time of inspection.

Figure 11A:
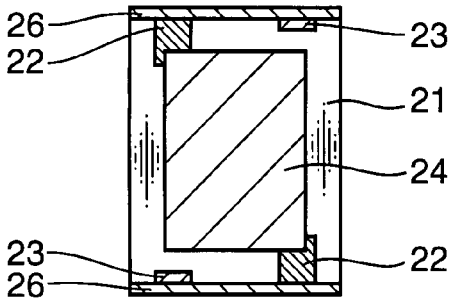
FIGS. 11A and 11B are top plan views showing modified patterns of a resistive element of the chip resistor in the second embodiment.
Figure 11B:
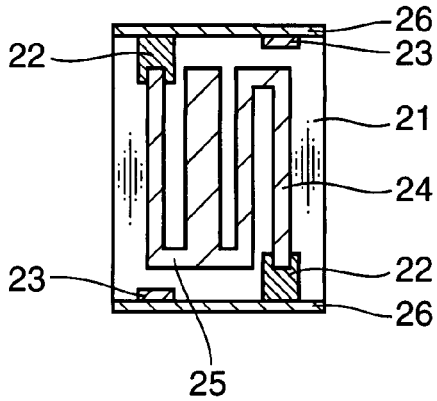

FIGS. 11A and 11B are diagrams showing modified patterns of the resistive element 24 in the chip resistor according to the second embodiment of the invention. As shown in FIG. 11A, the meandering portion 25 may be eliminated from the resistive element 24. Further alternatively, as shown in FIG. 11B, the meandering portion 25 may be formed into various shapes.

In the second embodiment, the dummy electrode 23 is smaller in shape than the upper surface electrode 22, with its width substantially the same as that of the upper surface electrode 22, and the length smaller than that of the upper surface electrode 22 to form the dummy electrode 23 smaller in shape than the upper surface electrode 22. Alternatively, for instance, making the width of the dummy electrode 23 smaller than that of the upper surface electrode 22, in addition to making the length of the dummy electrode 23 smaller than that of the upper surface electrode 22, also enables to obtain a similar effect as in the second embodiment.

In the second embodiment, the upper surface electrodes 22 and the dummy electrodes 23 are formed by screen-printing the electrode paste containing silver as the main ingredient and by sintering the electrode paste at 850° C.; and the resistive elements 24 are formed by screen-printing the resistive paste of ruthenium-based oxide and by sintering the resistive paste at 850° C. The method for forming the upper surface electrodes 22, the dummy electrodes 23, and the resistive elements 24 is not limited to the above, but may be formed by using a metallic thin film obtained by sputtering or a like process. The altered arrangement also enables to obtain a similar effect as in the second embodiment.

Figure 12:
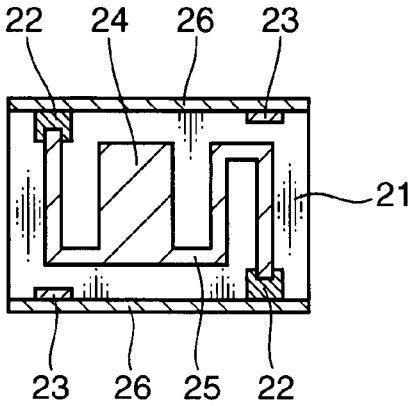
FIG. 12 is a top plan view showing a modification of the chip resistor in the second embodiment.

FIG. 12 is a top plan view showing a modification of the chip resistor according to the second embodiment of the invention. FIG. 12 is different from FIG. 7 describing the second embodiment in that a pair of upper surface electrodes 22 are formed at opposing side portions on an upper surface of a rectangular substrate 21 as opposed to each other with respect to a center line extending in a direction connecting the opposing side portions of the rectangular substrate 21 i.e. the shorter-side direction of the rectangular substrate 21. A pair of dummy electrodes 23 are formed at the opposing side portions on the upper surface of the rectangular substrate 21 at positions symmetrical relative to the upper surface electrode pair 22 with respect to a center line extending in a direction orthogonal to the direction connecting the opposing side portions of the rectangular substrate 21 i.e. the longer-side direction of the rectangular substrate 21. Also, a resistive element 24 is bridgingly formed between the upper surface electrode pair 22 to be electrically connected thereto. Further, a pair of end surface electrodes 26 are formed on end surfaces of the opposing side portions on the upper surface of the rectangular substrate 21 so that the end surface electrodes 26 are electrically connected with the upper surface electrode pair 22 and with the dummy electrode pair 23. With the modified arrangement, a similar effect as in the second embodiment can also be obtained.

Third Embodiment

In the following, the third embodiment of the invention is described.

Figure 13:
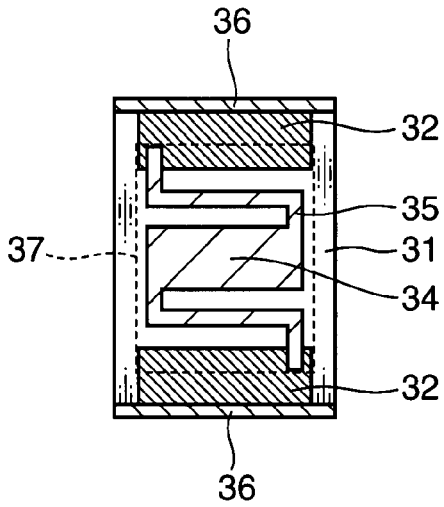
FIG. 13 is a top plan view of a chip resistor in a third embodiment of the invention.

FIG. 13 is a top plan view of a chip resistor according to the first embodiment of the invention.

Referring to FIG. 13, the reference numeral 31 denotes a rectangular substrate made of alumina, with an oblong shape in planar view. The reference numeral 32 denotes a pair of upper surface electrodes formed at opposing side portions on an upper surface of the rectangular substrate 31 in a direction along the extending direction of the side portions of the rectangular substrate 31 i.e. the shorter-side direction of the rectangular substrate 31. The upper surface electrode pair 12 is formed by screen-printing an electrode paste containing silver as a main ingredient and by sintering the electrode paste at 850° C. The reference numeral 34 denotes a resistive element which is bridgingly formed between the upper surface electrode pair 32 on the upper surface of the rectangular substrate 31 to be electrically connected to the upper surface electrode pair 32. The resistive element 34 is formed by screen-printing a resistive paste of ruthenium-based oxide and by sintering the resistive paste at 850° C. The resistive element 34 has a meandering portion 35, and is meanderingly formed between respective one parts of the upper surface electrode pair 12, i.e. parts thereof at diagonal positions of the rectangular substrate 31. The meandering portion 35 has a potential difference and is in close contact with the other parts of the upper surface electrode pair 32 i.e. the parts other than the one parts at the diagonal positions. The reference numeral 37 denotes a glass coat for covering the resistive element 34, with such dimensions as to bridge over the upper surface electrode pair 32. The glass coat 37 is formed by screen-printing a glass paste of lead borate silicate and by sintering the glass paste at 600 to 850° C. Specifically, the glass coat 37 covers an area including inner end portions of the upper surface electrode pair 12. The reference numeral 36 denotes a pair of end surface electrodes formed on end surfaces of the opposing side portions on the upper surface of the rectangular substrate 31 to be electrically connected with the upper surface electrode pair 32. The end surface electrode pair 36 is formed by coating an end surface electrode material containing silver and an epoxy resin and by curing the electrode material at 200° C.

Figure 14:
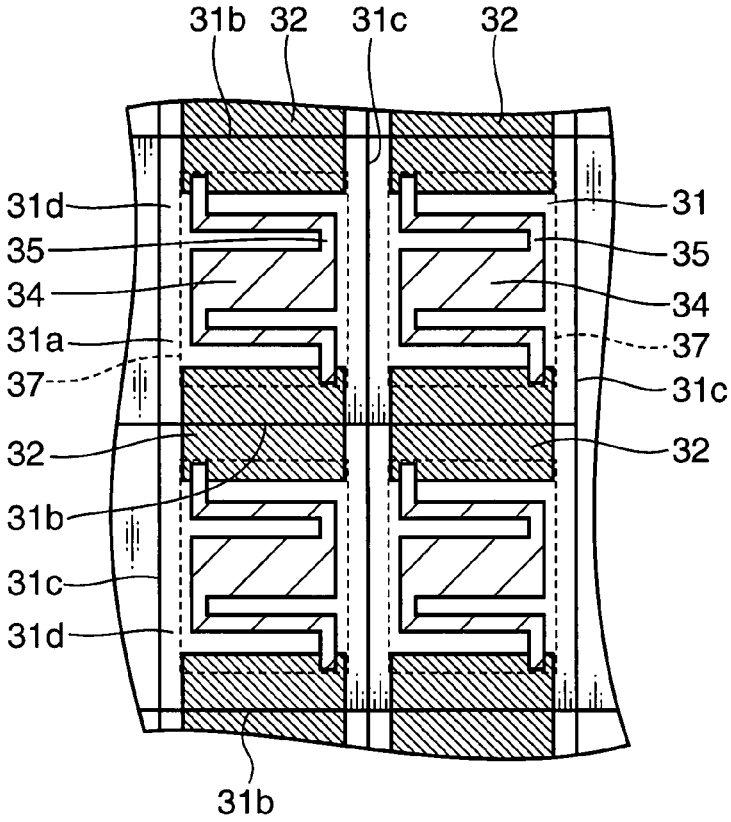
FIG. 14 is a top plan view of a sheet-like substrate to be used in a process for manufacturing the chip resistor in the third embodiment.

FIG. 14 is a top plan view of a sheet-like substrate to be used in a process for manufacturing the chip resistor according to the third embodiment of the invention.

The sheet-like substrate 31*a* shown in FIG. 14 is formed with, on one surface or both surfaces thereof, first dividing grooves 31*b* for dividing the substrate 31*a* into a number of substrate strips, and second dividing grooves 31*c* for dividing the substrate strips into a number of substrate pieces, in a grid pattern. With this arrangement, the sheet-like substrate 31*a* has a number of rectangular substrates 31 to be formed in a checkered pattern via the first dividing grooves 31*b* and the second dividing grooves 31*c*.

In the following, a method for manufacturing the chip resistor according to the third embodiment of the invention is described referring to FIG. 14.

First, a pair of upper surface electrodes 32 extending along the first dividing grooves 31*b* are formed by screen-printing an electrode paste containing silver as a main ingredient and by sintering the electrode paste at 850° C. at inner positions of the opposing first dividing grooves 31*b* in each of rectangular substrates 31 to be formed on the sheet-like substrate 31*a*, on an area substantially covering the first dividing grooves 31*b* in the sheet-like substrate 31*a*.

Next, resistive elements 34 each in a predetermined shape and with a meandering portion 35 are formed by screen-printing a resistive paste of ruthenium-based oxide on the upper surface of the respective rectangular substrates 31 and by sintering the resistive paste at 850° C. so that each of the resistive elements 34 is bridgingly formed between the upper surface electrode pair 32 at the diagonal positions of the rectangular substrate 31 and are electrically connected to the upper surface electrode pair 32.

Next, the glass coat 37 is formed by screen-printing a glass paste of lead borate silicate and by sintering the glass paste at 600 to 850° C. so that the entirety of the respective resistive elements 14 is covered and that the inner end portions of the upper surface electrode pair 32 on each of the rectangular substrates 31 are covered substantially along the entire width of the respective upper surface electrodes 32. Then, a resin coat (not shown) containing an epoxy resin is formed by screen-printing to cover substantially the entirety of the glass coat 37.

Next, a number of substrate strips 31*d* are formed by dividing the sheet-like substrate 31*a* along the first dividing grooves 31*b*. Thereafter, end surface electrodes 36 are formed by coating an end surface electrode material containing silver and an epoxy resin onto end surfaces of each of the substrate strips 31*d* so that the end surface electrodes 36 are electrically connected with the counterpart upper surface electrodes 32.

Next, a number of substrate pieces 31*e*, one of which is shown in FIG. 13, are formed by dividing the substrate strips 31*d* along the second dividing grooves 31*c*. Thereafter, by coating the end surface electrodes 36 of each of the substrate pieces 31*e* with nickel plating (not shown) and tin plating (not shown), the chip resistor as shown in FIG. 13 is produced.

In the third embodiment, as mentioned above, the upper surface electrode pair 32 is formed at the opposing side portions of each of the rectangular substrates 31 to be formed on the sheet-like substrate 31*a* along the extending direction of the opposing side portions of the rectangular substrate 31. With this arrangement, before the sheet-like substrate 31*a* is divided into a number of the rectangular substrates 31, the sheet-like substrate 31*a* is constructed in such a manner that the upper surface electrodes 32 formed at the opposing side portions of each of the rectangular substrates 31 are sequentially formed by way of the first dividing grooves 31*b*. With this arrangement, in forming the upper surface electrode pairs 32 or the resistive elements 34 by printing, sputtering, or a like process, with use of the sheet-like substrate 31*a* where the number of the rectangular substrates 31 are to be formed in a checkered pattern via the first dividing grooves 31*b* and the second dividing grooves 31*c*, the following advantage is obtained. Specifically, even if forming position of the upper surface electrodes 32 is displaced from where they are supposed to be formed, the upper surface electrodes 32 are formed over the first dividing grooves 31*b*. This arrangement enables to securely perform electrical connection of the upper surface electrodes 32 and the counterpart end surface electrodes 36 in forming the end surface electrodes 36 on the opposing end surfaces of each of the substrate strips 31*d*, after the sheet-like substrate 31*a* is divided into the number of the substrate strips 31*d* along the first dividing grooves 31*b*. Also, the end surface electrodes 36 are contacted with the upper surface electrodes 32 with a large contact area. This enables to enhance adhesion of the end surface electrodes 36, as compared with the conventional arrangement. Further, the space between the upper surface electrodes 32 and the resistive element 35 can be completely shielded by the glass coat 37 without moisture intrusion. Accordingly, even if the upper surface electrode pair 32 is made of a silver-based material, which is a general material for chip resistors, and adhesion and moisture resistance of a protective resin coat are insufficient, this arrangement enables to suppress electrical migration of the silver component in the upper surface electrode 32 to the resistive element 34 when the chip resistor is used in load and moisture ambient condition. Also, since the glass coat 37 is covered with the resin coat, the resin coat prevents the glass coat 37 from cracks at the time of production or use of the chip resistor. This is more advantageous in suppressing electrical migration.

Figure 15A:
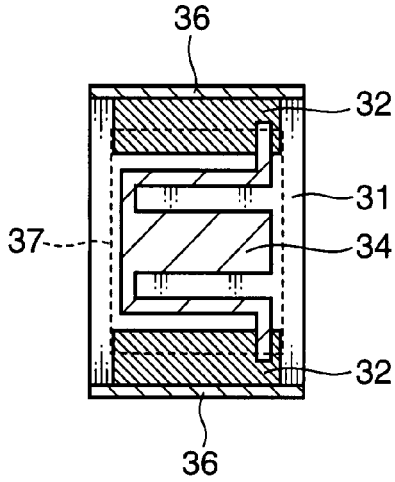
FIGS. 15A through 15C are top plan views showing modifications of the chip resistor in the third embodiment.
Figure 15B:
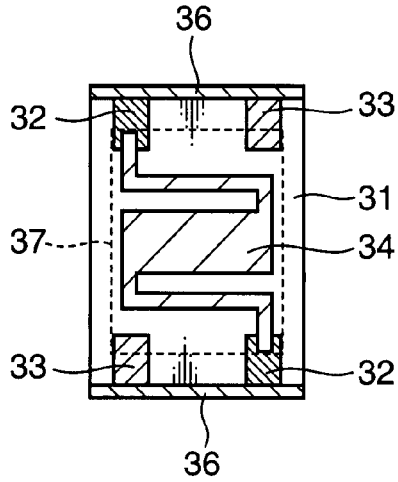
Figure 15C:
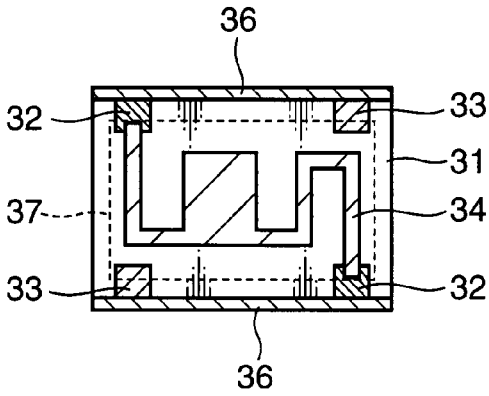
Figure 16:
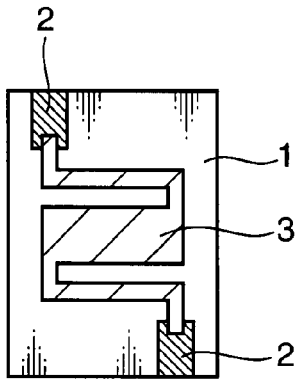
FIG. 16 is a top plan view showing a conventional chip resistor.
Figure 17:
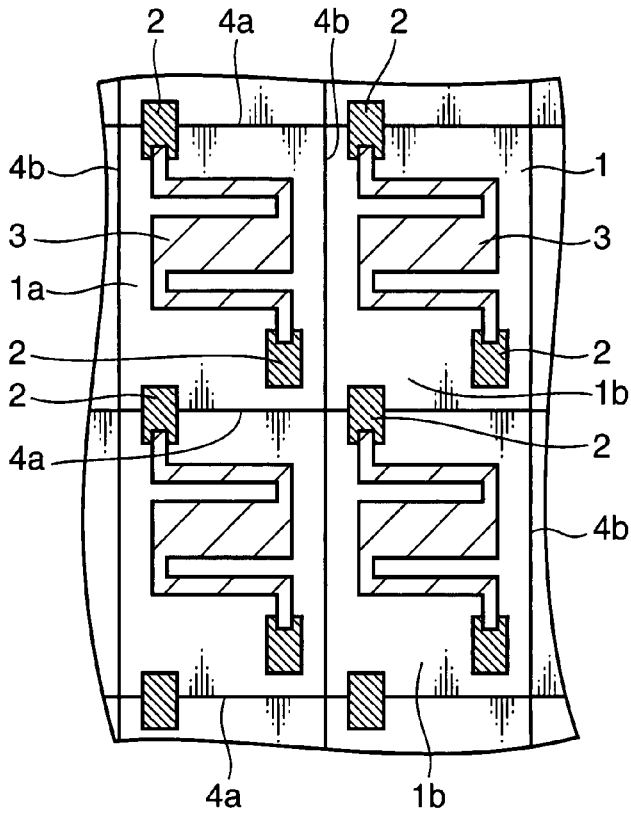
FIG. 17 is a top plan view of a sheet-like substrate with printing displacement of upper surface electrodes in a process for manufacturing the conventional chip resistor.
Figure 18:
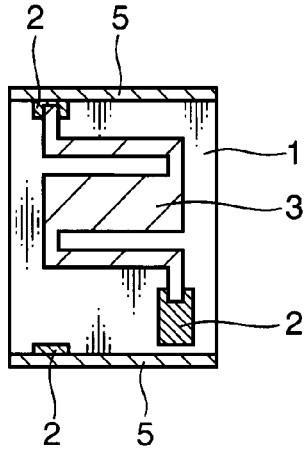
FIG. 18 is a top plan view of a substrate piece obtained by dividing the sheet-like substrate shown in FIG. 14.

FIGS. 15A through 15C are diagrams showing modified patterns of the resistive element 24 in the chip resistor according to the third embodiment of the invention. As shown in FIG. 15A, the resistive element 24 may be formed between the opposing parts of the upper surface electrode pair 32 in the longer-side direction of the rectangular substrate 31, in place of the parts of the upper surface electrode pair 32 at the diagonal positions of the rectangular substrate 31.

As an altered arrangement, as shown in FIGS. 15B and 15C, the third embodiment is applicable to the chip resistor according to the first or the second embodiment of the invention. In the altered arrangement, the glass coat 37 may have such dimensions as to bridge over a pair of dummy electrodes 33. In other words, the glass coat 37 may cover the parts of the dummy electrode pair 33 where the dummy electrode pair 33 opposes the resistive element 34. Similarly to the third embodiment, the altered arrangement also enables to suppress electrical migration between the dummy electrodes 33 and the resistive element 34.

SUMMARY

As mentioned above, a chip resistor according to an aspect of the invention comprises: a pair of upper surface electrodes formed at opposing side portions of a rectangular substrate as opposed to each other with respect to a center line of the rectangular substrate extending in a direction connecting the side portions; a resistive element formed on the rectangular substrate to be electrically connected to the upper surface electrode pair; a pair of end surface electrodes formed on end surfaces of the opposing side portions of the rectangular substrate, and electrically connected to the upper surface electrode pair; and dummy electrodes formed individually at the opposing side portions of the rectangular substrate at surfaces of the opposing side portions of the rectangular substrate, and electrically connected to the upper surface electrode pair; and dummy electrodes formed individually at the opposing side portions of the rectangular substrate at positions corresponding to the upper surface electrode pair in the direction connecting the side portions.

With the above arrangement, the dummy electrode pair is formed at the opposing side portions of the rectangular substrate at the positions symmetrical relative to the upper surface electrode pair with respect to the center line of the rectangular substrate extending in the direction orthogonal to the direction connecting the side portions. Accordingly, before a sheet-like substrate is divided into a number of the rectangular substrates, the upper surface electrodes formed at the opposing side portions of the respective rectangular substrates, and the dummy electrodes formed at the opposing side portions of the respective adjacent rectangular substrates are sequentially formed via first dividing grooves. With this arrangement, in forming the upper surface electrode pairs, the dummy electrode pairs, or the resistive elements by printing, sputtering, or a like process, with use of the sheet-like substrate where the number of the rectangular substrates are to be formed in a checkered pattern via the first dividing grooves and second dividing grooves, the following advantage is obtained. Specifically, even if forming position of the upper surface electrodes is displaced, and therefore, the upper surface electrodes are formed away from the first dividing grooves, i.e. away from the opposing end portions of the rectangular substrate, the dummy electrodes which are sequentially formed with the upper surface electrodes are formed over the first dividing grooves. This arrangement enables to securely perform electrical connection of the upper surface electrodes and the end surface electrodes via the counterpart dummy electrodes, in forming the end surface electrodes on the opposing end surfaces of each of substrate strips obtained by dividing the sheet-like substrate along the first dividing grooves. Also, the end surface electrodes are formed on the dummy electrodes as well as on the upper surface electrodes. This enables to improve adhesion of the end surface electrodes, as compared with an arrangement that the end surface electrodes are formed merely on the upper surface electrodes, because the adhesion force of the end surface electrodes to the electrodes is larger than the adhesion force of the end surface electrodes to the substrate.

Preferably, each of the upper surface electrode pair may protrude inwardly from the counterpart dummy electrode in the direction connecting the opposing side portions of the rectangular substrate.

With the above arrangement, since the dummy electrode is smaller in shape than the upper surface electrode. This enables to increase the area and the length of the resistive element by the size difference between the dummy electrode and the upper surface electrode.

Preferably, the end surface electrode pair may be formed from the end surfaces of the opposing side portions of the rectangular substrate to a part on an upper surface of the rectangular substrate, so that the respective end surface electrodes cover substantially an entire surface of the counterpart dummy electrode.

With the above arrangement, substantially the entire surface of the dummy electrode which is smaller in shape than the upper surface electrode is covered with the end surface electrode by bridging over both end portions on an upper surface of a substrate strip with the end surface electrodes. This arrangement enables to hide the dummy electrodes, which is advantageous in eliminating likelihood that an inspection instrument may erroneously identify the dummy electrodes as the upper surface electrodes at the time of inspection.

Preferably, in the chip resistor, a glass coat for covering the resistive element, with such dimensions as to bridge over the dummy electrode pair, and a resin coat for covering the glass coat may be formed on the rectangular substrate.

With the above arrangement, since the glass coat covers the space between the dummy electrodes and the resistive element, even if the dummy electrodes are made of a silver-based material, and the dummy electrodes are in close contact with the resistive element, electrical migration between the dummy electrodes and the resistive element can be suppressed. Also, since the glass coat is covered with the resin coat, the resin coat prevents the glass coat from cracks at the time of production or use of the chip resistor. This is more advantageous in suppressing electrical migration.

A chip resistor according to another aspect of the invention comprises: a pair of upper surface electrodes formed at opposing side portions of a rectangular substrate in a direction along an extending direction of the side portions; and a resistive element formed on the rectangular substrate to be electrically connected to a part of the upper surface electrode pair and to be brought into close contact with a part of the upper surface electrode pair other than the electrically connectable parts, wherein a glass coat for covering the resistive element, with such dimensions as to bridge over the upper surface electrode pair, and a resin coat for covering the glass coat are formed on the rectangular substrate.

With the above arrangement, the upper surface electrode pair is formed at the opposing side portions of the rectangular substrate to be formed on the sheet-like substrate in the direction along the extending direction of the opposing side portions of the rectangular substrate. With this arrangement, before the sheet-like substrate is divided into a number of the rectangular substrates, the sheet-like substrate is constructed in such a manner that the upper surface electrodes formed at the opposing side portions of each of the rectangular substrates are sequentially formed by way of the first dividing grooves. With this arrangement, in forming the upper surface electrode pairs or the resistive elements by printing, sputtering, or a like process, with use of the sheet-like substrate where the number of the rectangular substrates are to be formed in a checkered pattern via the first dividing grooves and second dividing grooves, the following advantage is obtained. Specifically, even if forming position of the upper surface electrodes is displaced from where they are supposed to be formed, the upper surface electrodes are formed over the first dividing grooves. This arrangement enables to securely perform electrical connection of the upper surface electrodes and the counterpart end surface electrodes in forming the end surface electrodes on the opposing end surfaces of each of substrate strips obtained by dividing the sheet-like substrate along the first dividing grooves. Also, the end surface electrodes are contacted with the upper surface electrodes with a large contact area. This enables to enhance adhesion of the end surface electrodes, as compared with the conventional arrangement. Further, the space between the upper surface electrodes and the resistive element can be covered with the glass coat. Accordingly, even if the upper surface electrodes are made of a silver-based material, this arrangement enables to suppress electrical migration between the upper surface electrodes and the resistive element. Also, since the glass coat is covered with the resin coat, the resin coat prevents the glass coat from cracks at the time of production or use of the chip resistor. This is more advantageous in suppressing electrical migration.

A chip resistor manufacturing method according to yet another aspect of the invention comprises: a step of forming a pair of upper surface electrodes at inner positions of opposing first dividing grooves in each of rectangular substrates to be formed on a sheet-like substrate as opposed to each other with respect to a center line of the rectangular substrate extending in a direction connecting the opposing first dividing grooves, with use of the sheet-like substrate where a number of the rectangular substrates are to be formed in a checkered pattern via the first dividing grooves and second dividing grooves; a step of forming a pair of dummy electrodes at inner positions of the opposing first dividing grooves in the each of the rectangular substrates to be formed on the sheet-like substrate at positions symmetrical relative to the upper surface electrode pair with respect to a center line of the rectangular substrate extending in a direction orthogonal to the direction connecting the opposing first dividing grooves; a step of forming a resistive element on the each of the rectangular substrates to be electrically connected to the upper surface electrode pair; and a step of forming end surface electrodes on opposing end surfaces of a substrate strip obtained by dividing the sheet-like substrate along the first dividing grooves so that the end surface electrodes are electrically connected to the upper surface electrode pair, wherein the upper surface electrode formation step and the dummy electrode formation step are simultaneously conducted so that the one of the dummy electrodes and the one of the upper surface electrodes on the respective rectangular substrates are respectively electrically connected to the corresponding one of the upper surface electrodes and to the corresponding one of the dummy electrodes on the respective adjacent rectangular substrates via the first dividing grooves.

The above-mentioned manufacturing method comprises the step of forming the dummy electrode pair at the inner positions of the opposing first dividing grooves in each of the rectangular substrates to be formed on the sheet-like substrate at the positions symmetrical relative to the upper surface electrode pair with respect to the center line of the rectangular substrate extending in the direction orthogonal to the direction connecting the opposing first dividing grooves, and has the feature that the upper surface electrodes and the dummy electrodes are simultaneously formed so that the one of the dummy electrodes and the one of the upper surface electrodes on the respective rectangular substrates are respectively electrically connected to the corresponding one of the upper surface electrodes and to the corresponding one of the dummy electrodes on the respective adjacent rectangular substrates via the first dividing grooves. With this arrangement, before the sheet-like substrate is divided to obtain the number of the rectangular substrates, the upper surface electrodes formed at the inner positions of the opposing first dividing grooves in the respective rectangular substrates to be formed on the sheet-like substrate, and the dummy electrodes formed at the inner positions of the opposing first dividing grooves in the respective adjacent rectangular substrates are sequentially formed via the first dividing grooves. With this arrangement, in forming the upper surface electrode pairs, the dummy electrode pairs, or the resistive elements by printing, sputtering, or a like process, with use of the sheet-like substrate where the number of the rectangular substrates are to be formed in a checkered pattern via the first dividing grooves and second dividing grooves, the following advantage is obtained. Specifically, even if forming position of the upper surface electrodes is displaced, and therefore, the upper surface electrodes are formed away from the first dividing grooves, the dummy electrodes which are sequentially formed with the upper surface electrodes are formed over the first dividing grooves. This arrangement enables to securely perform electrical connection of the upper surface electrodes and the end surface electrodes via the counterpart dummy electrodes, in forming the end surface electrodes on the opposing end surfaces of each of substrate strips obtained by dividing the sheet-like substrate along the first dividing grooves. Also, the end surface electrodes are formed on the dummy electrodes as well as on the upper surface electrodes. This enables to improve adhesion of the end surface electrodes, as compared with an arrangement that the end surface electrodes are formed merely on the upper surface electrodes, because the adhesion force of the end surface electrodes to the electrodes is larger than the adhesion force of the end surface electrodes to the substrate.

Also, since the upper surface electrodes and the dummy electrodes are sequentially formed via the first dividing grooves, a large contact area can be secured for contacting with a terminal for measuring a four-terminal resistance in measuring the resistance of the respective resistive members. This enables to securely measure the four-terminal resistance.

Preferably, according to the above chip resistor manufacturing method, in the dummy electrode formation step, the dummy electrode may be formed with a size smaller than a size of the upper surface electrode in the direction connecting the opposing first dividing grooves, and in the end surface electrode formation step, substantially an entire surface of the dummy electrode may be covered with the counterpart end surface electrode by forming the respective end surface electrodes from an end surface of the substrate strip to a part on an upper surface thereof.

With the above arrangement, the dummy electrode is smaller in shape than the upper surface electrode. This enables to increase the area and the length of the resistive element by the size difference between the dummy electrode and the upper surface electrode, thereby improving load characteristics such as anti-pulse characteristics.

Also, substantially the entire surface of the dummy electrode which is smaller in shape than the upper surface electrode is covered with the counterpart end surface electrode by bridging over both end portions on the upper surface of the substrate strip with the end surface electrodes. This arrangement enables to hide the dummy electrodes, which is advantageous in eliminating likelihood that an inspection instrument may erroneously identify the dummy electrodes as the upper surface electrodes at the time of inspection.

Preferably, the above chip resistor manufacturing method may further comprise a step of forming, on the respective rectangular substrates to be formed on the sheet-like substrate, a glass coat for covering the resistive element, with such dimensions as to bridge over the dummy electrode pair, and of forming a resin coat for covering the glass coat.

With the above arrangement, since the glass coat covers the space between the dummy electrodes and the resistive element, even if the dummy electrodes are made of a silver-based material, and the dummy electrodes are in close contact with the resistive element, electrical migration between the dummy electrodes and the resistive element can be suppressed. Also, since the glass coat is covered with the resin coat, the resin coat prevents the glass coat from cracks at the time of production or use of the chip resistor. This is more advantageous in suppressing electrical migration.

A chip resistor manufacturing method according to still another aspect of the invention comprises: a step of forming a pair of upper surface electrodes at inner positions of opposing first dividing grooves in each of rectangular substrates to be formed on a sheet-like substrate in a direction along an extending direction of the first dividing grooves, by forming the respective electrodes on an area substantially covering the first dividing grooves in the sheet-like substrate, with use of the sheet-like substrate where a number of the rectangular substrates are to be formed in a checkered pattern via the first dividing grooves and second dividing grooves; a step of forming a resistive element on each of the rectangular substrates to be electrically connected to a part of the upper surface electrode pair and to be brought into close contact with a part of the upper surface electrode pair other than the electrically connectable parts; a step of forming, on the each of the rectangular substrates to be formed on the sheet-like substrate, a glass coat for covering the resistive element, with such dimensions as to bridge over the upper surface electrode pair, and of forming a resin coat for covering the glass coat; and a step of forming end surface electrodes on opposing end surfaces of a substrate strip obtained by dividing the sheet-like substrate along the first dividing grooves so that the end surface electrodes are electrically connected to the upper surface electrode pair.

According to the above manufacturing method, the upper surface electrode pair is formed at the opposing side portions of the rectangular substrate to be formed on the sheet-like substrate in the direction along the extending direction of the opposing side portions of the rectangular substrate. With this arrangement, before the sheet-like substrate is divided into a number of the rectangular substrates, the sheet-like substrate is constructed in such a manner that the upper surface electrodes formed at the opposing side portions of each of the rectangular substrates are sequentially formed by way of the first dividing grooves. With this arrangement, in forming the upper surface electrode pairs or the resistive elements by printing, sputtering, or a like process, with use of the sheet-like substrate where the number of the rectangular substrates are to be formed in a checkered pattern via the first dividing grooves and second dividing grooves, the following advantage is obtained. Specifically, even if forming position of the upper surface electrodes is displaced from where they are supposed to be formed, the upper surface electrodes are formed over the first dividing grooves. This arrangement enables to securely perform electrical connection of the upper surface electrodes and the counterpart end surface electrodes in forming the end surface electrodes on the opposing end surfaces of each of substrate strips obtained by dividing the sheet-like substrate along the first dividing grooves. Also, the end surface electrodes are contacted with the upper surface electrodes with a large contact area. This enables to enhance adhesion of the end surface electrodes, as compared with the conventional arrangement. Further, the space between the upper surface electrodes and the resistive element can be covered with the glass coat. Accordingly, even if the upper surface electrodes are made of a silver-based material, this arrangement enables to suppress electrical migration between the upper surface electrodes and the resistive element. Also, since the glass coat is covered with the resin coat, the resin coat prevents the glass coat from cracks at the time of production or use of the chip resistor. This is more advantageous in suppressing electrical migration.

EXPLOITATION IN INDUSTRY

The chip resistor of the invention enables to securely perform electrical connection of an upper surface electrode to an end surface electrode even if a number of upper surface electrodes and resistive elements are formed with displacement by printing, sputtering, or a like process. The chip resistor of the invention also enables to increase the area for contacting with a terminal for measuring a four-terminal resistance in measuring the resistance of the respective resistive members, thereby securely measuring the four-terminal resistance. Thus, the invention is useful in producing a chip resistor with improved load characteristics such as anti-pulse characteristics.

The invention claimed is:

1. A chip resistor comprising:

a rectangular substrate having opposing side portions;

a pair of upper surface electrodes, formed at the opposing side portions of the rectangular substrate, respectively, opposed to each other with respect to a center line of the rectangular substrate extending in a direction from one side portion to the other side portion;

a resistive element, formed on the rectangular substrate, to be electrically connected directly to the upper surface electrode pair;

a pair of end surface electrodes, formed on end surfaces of the opposing side portions of the rectangular substrate and electrically connected to the upper surface electrode pair, respectively; and formed individually at the opposing side portions of the rectangular substrate, so that the dummy electrodes are opposed to their counterpart upper surface electrodes with respect to the center line, respectively, wherein the dummy electrodes are not connected directly to the resistive element.

2. The chip resistor according to claim 1, wherein the upper surface electrode pair protrudes farther inward than their counterpart dummy electrodes in the direction from one side portion to the other side portion of the rectangular substrate, respectively.

3. The chip resistor according to claim 2, wherein the end surface electrode pair is formed from the end surfaces of the opposing side portions of the rectangular substrate to a part on an upper surface of the rectangular substrate, so that the respective end surface electrodes cover substantially an entire surface of their counterpart dummy electrodes, respectively.

4. The chip resistor according to claim 1, wherein a glass coat for covering the resistive element, with such dimensions as to bridge over the dummy electrode pair, and a resin coat for covering the glass coat are formed on the rectangular substrate.

5. The chip resistor according to claim 1, wherein a glass coat for covering the resistive element, with such dimensions as to bridge over the upper surface electrode pair, and a resin coat for covering the glass coat are formed on the rectangular substrate.

6. A method for manufacturing a chip resistor, comprising:

a step of forming a pair of upper surface electrodes, at inner positions of two opposing first dividing grooves, respectively, in each of a plurality of rectangular substrates formed on a sheet-like substrate, opposed to each other with respect to a center line of the rectangular substrate extending in a direction from one first dividing groove to the other first dividing groove, the sheet-like substrate having the plurality of rectangular substrates formed in a checkered pattern via the first dividing grooves and second dividing grooves;

at inner positions of the two opposing first dividing grooves, so that the pair of dummy electrodes are opposed to their counterpart upper surface electrodes with respect to the center line, respectively;

a step of forming a resistive element, on each of the rectangular substrates, to be electrically connected directly to the upper surface electrode pair and not directly connected to the pair of dummy electrodes; and a step of forming end surface electrodes, on opposing end surfaces of a substrate strip obtained by dividing the sheet-like substrate along the first dividing grooves, so that the end surface electrodes are electrically connected to the upper surface electrode pair, wherein the upper surface electrode formation step and the dummy electrode formation step are simultaneously conducted so that one of the dummy electrodes and one of the upper surface electrodes, on a rectangular substrate, are electrically connected to the corresponding one of the upper surface electrodes and the corresponding one of the dummy electrodes on an adjacent rectangular substrate via the first dividing grooves, respectively.

7. The chip resistor manufacturing method according to claim 6, wherein direction from one first dividing groove to the other first dividing groove, and in the end surface electrode formation step, the end surface electrodes are formed so that substantially an entire surface of the dummy electrodes are covered with the counterpart end surface electrodes, respectively, by forming the end surface electrodes from an end surface of the substrate strip to a part on an upper surface thereof.

8. The chip resistor manufacturing method according to claim 6, further comprising:

a step of forming, on the respective rectangular substrates formed on the sheet-like substrate, a glass coat for covering the resistive element, with such dimensions as to bridge over the dummy electrode pair; and a step of forming a resin coat for covering the glass coat.

9. A method for manufacturing a chip resistor, comprising:

a step of forming a pair of upper surface electrodes, at inner positions of two opposing first dividing grooves, respectively, in each of a plurality of rectangular substrates formed on a sheet-like substrate, in a direction along an extending direction of the first dividing grooves, by forming the upper surface electrode pair on an area substantially covering the two first dividing grooves in the sheet-like substrate, respectively, the sheet-like substrate having the plurality of rectangular substrates formed in a checkered pattern via the first dividing grooves and second dividing grooves;

a step of forming a resistive element, on each of the rectangular substrates, to be electrically connected to a part of the upper surface electrode pair and to be close to a part of the upper surface electrode pair other than electrically connectable parts;

a step of forming, on the each of the rectangular substrates formed on the sheet-like substrate, a glass coat for covering the resistive element, with such dimensions as to bridge over the upper surface electrode pair;

a step of forming a resin coat for covering the glass coat; and a step of forming end surface electrodes, on opposing end surfaces of a substrate strip obtained by dividing the sheet-like substrate along the first dividing grooves, so that the end surface electrodes are electrically connected to the upper surface electrode pair.

* * * * *